United States Patent [19]

Jackson et al.

[11] Patent Number: 4,782,738

[45] Date of Patent: Nov. 8, 1988

[54] COMPRESSOR WITH ADJUSTABLE HEAD CLEARANCE

[75] Inventors: Floyd G. Jackson, Baroda; Michael L. Beidler, St. Joseph, both of Mich.

[73] Assignee: Gast Manufacturing Corporation, Benton Harbor, Mich.

[21] Appl. No.: 777,232

[22] Filed: Sep. 18, 1985

[51] Int. Cl.[4] ..... F01B 31/14

[52] U.S. Cl. ..... 92/60.5; 92/128; 72/254; 72/255

[58] Field of Search ..... 92/13.6, 51, 59, 60.5, 92/117 R, 128; 29/417, 527.6; 72/254, 255

[56] References Cited

U.S. PATENT DOCUMENTS

| | | | |
|---|---|---|---|
| 1,636,001 | 7/1927 | Kalsey | 92/60.5 X |
| 1,951,558 | 3/1934 | Nystrom | 92/60.5 X |
| 2,765,779 | 10/1956 | Graves | 121/141 |
| 2,943,895 | 7/1960 | Miller | 309/3 |
| 2,976,813 | 3/1961 | Redman | 103/216 |
| 3,139,009 | 6/1964 | Harting | 92/171 |
| 3,209,659 | 10/1965 | Colwell | 92/171 |
| 3,375,972 | 4/1968 | Raufeisen | 230/172 |
| 3,386,424 | 6/1968 | Appeman | 123/48 |
| 3,432,177 | 3/1969 | Colwell | 277/205 |
| 3,521,607 | 7/1970 | Wiseman et al. | 123/41.69 |
| 3,568,573 | 3/1971 | Bailey et al. | 92/171 |
| 3,751,048 | 8/1973 | Rode | 277/200 |
| 3,774,896 | 11/1973 | Rode | 267/182 |
| 3,841,796 | 10/1974 | Schlanzky | 92/60.5 X |
| 3,900,232 | 8/1975 | Rode | 308/1 R |
| 3,981,631 | 9/1976 | Kemp | 417/312 |
| 4,055,978 | 1/1977 | Torralba | 72/254 |
| 4,067,585 | 1/1978 | Rode | 277/200 |
| 4,125,929 | 11/1978 | Rode | 29/446 |
| 4,214,465 | 7/1980 | Rode | 72/36 |

FOREIGN PATENT DOCUMENTS

| | | | |
|---|---|---|---|
| 101233 | 9/1896 | Fed. Rep. of Germany | 92/171 |
| 552443 | 5/1923 | France | 92/60.5 |
| 313250 | 12/1933 | Italy . | |

OTHER PUBLICATIONS

"Gast ROC-R Compressor" Gast. Manufacturing Co.

*Primary Examiner*—Robert E. Garrett
*Assistant Examiner*—Mark A. Williamson
*Attorney, Agent, or Firm*—Price, Heneveld, Cooper, DeWitt & Litton

[57] ABSTRACT

A compressor includes a housing to which a cylinder and head structure is adjustably mounted by means of an adjustable spacer. By adjusting the compression on the head structure during assembly, the head clearance of the compressor piston is adjusted for a desired operating characteristic. In a preferred embodiment the compressor includes an extruded housing as well as other major components.

18 Claims, 2 Drawing Sheets

COMPRESSOR WITH ADJUSTABLE HEAD CLEARANCE

BACKGROUND OF THE INVENTION

The present invention pertains to a relatively small, compact compressor and one with an adjustable spacer for varying the performance characteristics.

Relatively small and inexpensive compressors in the range of from 0.5 to 1½ cubic feet per minute (CFM) capacity have a variety of modern-day applications. Such compressors provide an output pressure nominally ranging from 20 to 60 pounds per square inch (PSIG) and can be used for domestic paint applicating equipment and other relatively light-duty applications. Thus, typically these relatively small compressors are directed to the consumer market, and as such it is necessary to maintain the cost of the units as low as possible for placement in this market.

The head clearance (i.e., the spacing between the top of the piston head employed in the piston-type compressors and the valve plate utilized for controlling the airflow therethrough) has a dramatic effect on the performance characteristics in terms of flow rate at a given pressure. In order to provide a desired flow rate at a duty output pressure, it is necessary to carefully control this clearance; and in the prior art, adjustable shims and precision machining have been employed by the manufacturer to assure the desired performance characteristics. In some cases, it is necessary for the assembly personnel to select a shim, test the unit and substitute a different shim and possibly repeat this process in order to provide the desired performance characteristics. Thus, the assembly operation can add significantly to the overall cost of the unit by increasing the labor involved in assembly of such compressors.

Further, typically the housings and other major structural elements of the compressors have been cast of aluminum; and although preferable to machining, the cast parts are themselves relatively expensive due to the mold costs.

SUMMARY OF THE PRESENT INVENTION

The present invention overcomes the difficulty of the prior art by providing an adjustable compressible spacer between a compressor housing and the compressor cylinder and head such that a factory adjustment can be readily made without using one or a combination of different shims, and the operating characteristics can be adjusted quickly and easily during assembly. Further, the compressor of the present invention incorporates extruded aluminum parts for the major components thereby greatly reducing the cost.

The compressor of the present invention therefore provides an improved compressor having a housing for receiving a prime mover with an opening for a cylinder. A cylinder extends into the housing for receiving a piston and has flange means overlaying the periphery of the housing opening. A piston is mounted within the cylinder, and an adjustable spacer is positioned between the cylinder flange and housing with a head assembly enclosing the cylinder. Fastening means are provided for securing the head to the housing for compressing the adjustable spacer to provide a predetermined head clearance and therefore selectable operating characteristics for the compressor.

In a preferred embodiment of the invention, the housing comprises an extruded member having integral floor, opposite side walls and a top, with the top including an opening formed therein for receiving the cylinder. One of the side walls incudes an aperture for receiving the drive shaft of a motor for the compressor.

The resulting structure is a compact, relatively inexpensive compressor providing a range of flow rates versus pressure characteristics which can be factory selected and set with relative ease. By incorporating aluminum extrusions for the major structural components of the compressor such as the housing, connecting rod, and head, the cost of the improved compressor design is also reduced. These and other features, objects and advantages of the present invention will become apparent upon reading the following description thereof together with reference to the accompanying drawings in which:

DETAILED DESCRIPTION OF THE PREFERRED EMBODIMENT

Figure 1:
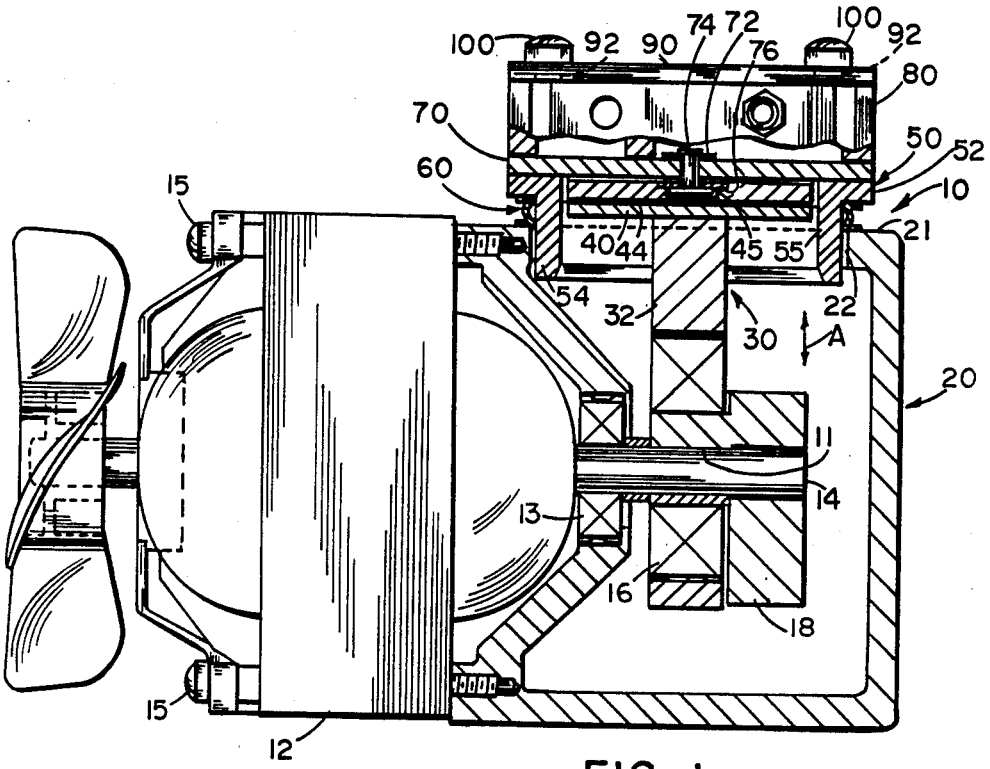
FIG. 1 is a fragmentary vertical cross section of a compressor embodying the present invention.

Referring initially to FIG. 1 there is shown a compressor 10 embodying the present invention. The compressor includes a housing 20 to which there is secured an electrical drive motor 12 having an output shaft 14 coupled to a piston assembly 30 by means of a bearing 16 and eccentric 18. Coupled to the upper portion of housing 20 through a circular opening 22 is a compressor cylinder 50 having a flange 52 overlaying the upper surface 21 of housing 20 around the periphery of opening 22. Between the cylinder 50 and housing 20 there is provided an adjustable spacer 60, and on top of cylinder 50 there is provided a valve plate assembly 70. The compressor assembly is completed with an extruded compressor head 80 and cover plate 90 secured to the housing 20 by fastening bolts 100.

Figure 8:
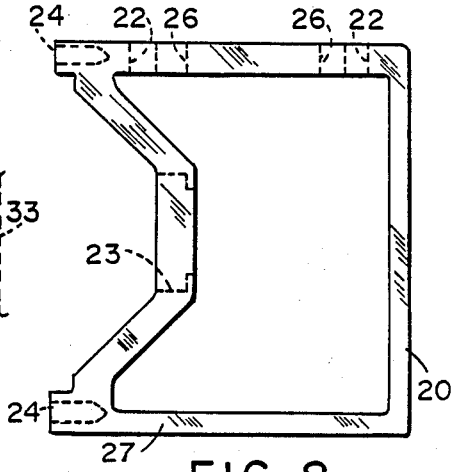
FIG. 8 is a front elevational view of the compressor housing shown also in FIG. 1.
Figure 9:
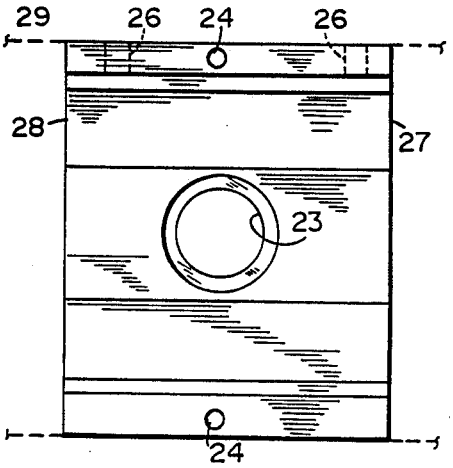
FIG. 9 is a left side elevational view of an extrusion showing the structure in FIG. 8.

Housing 20 is best seen in FIGS. 8 and 9 and is made of an extrusion of 6061-T5 aluminum with the cross section of the extrusion shown in FIG. 8. The housing includes integral top, bottom, and left and right sides with the top including the circular opening 22 for receiving cylinder 50. The left wall includes a configurated aperture 23 defining a bearing seat for receiving bearing 13 (FIG. 1) supporting the motor drive shaft 14 to the housing. The motor 12 is secured to the housing by two (2) threade apertures 24 formed in the extending lips of the left side wall by two (2) fastening bolts 15 (FIG. 1). Four (4) threaded apertures 26 are formed downwardly through the top 21 of housing 20 for receiving the head bolts 100. The longitudinal extrusion defining the housing is cut along the front and rear edges 27 and 28, respectively, from a length of extrusion 29 as shown in phantom form in FIG. 9 to define a plurality of housings 20 from a single length of the aluminum extrusion. The housing apertures shown in FIGS. 8 and 9 can be machined in the extrusion either prior to or subsequent to the cutting of the extrusion into individual housings.

Figure 6:
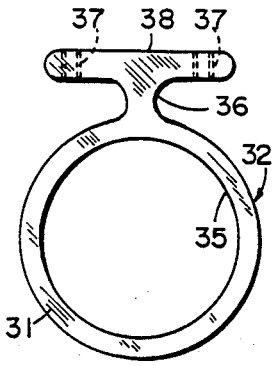
FIG. 6 is a right side elevational view of the connecting rod extrusion shown in FIG. 1.
Figure 7:
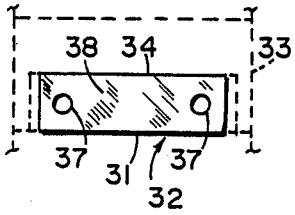
FIG. 7 is a top plan view of an extrusion showing the structure in FIG. 6.

The piston assembly 30 includes a connecting rod 32, seen in greater detail in FIGS. 6 and 7. Attached to the top of connecting rod 32 as seen in FIG. 1 is a circular spacer plate 40 on which there rests a cup-shaped piston seal 42 attached to spacer plate 40 by means of a piston cup retainer disk 44. Connecting rod 32 likewise is cut from an elongated extrusion 33 of 6061-T5 aluminum having a cross section as shown in FIG. 6. The extrusion is cut at front and back edges 31 and 34, respectively, to define individual connecting rods. Each connecting rod extrusion includes a lower ring-shaped segment having an inner cylindrical opening 35 for receiving bearing 16 coupling the piston assembly to drive shaft 14 through an eccentric and counterweight member 18 as best seen in FIG. 1. The eccentric 18 is secured to shaft 14 by suitable set screws (not shown) and has an eccentric cross section as illustrated in FIG. 1 such that as shaft 14 rotates, the piston reciprocates vertically upwardly and downwardly in cylinder 50 as illustrated in FIG. 1 by arrow A to provide the compressor action in connection with the cup seal, valve retainer and head chambers as described below.

The connecting rod integrally includes a rod 36 (FIG. 6) and a generally T-shaped top 38 having a pair of threaded apertures 37 extending therethrough for securing the cup retainer and spacer thereto by means of a pair of fastening bolts. Thus, as with housing 20, a plurality of individual connecting rods 32 are cut from an extrusion 33 either prior to or after the machining of threaded apertures 37 to provide several individual connecting rods. It is noted that the piston assembly is free of wrist pins and, therefore, tilts slightly in the cylinder 50 as the piston reciprocates. This is possible due to the relatively short piston cup retainer and spacer disk construction with the use of the seal 42 permitting reciprocal and tilting motion of the piston assembly within cylinder 50 during its compression and intake strokes.

Cylinder 50 is a generally cylindrical member having an upper peripheral or annular flange 52 overlaying the periphery of opening 22 on the top surface 21 of housing 20 and a downwardly depending cylindrical portion 54 which extends downwardly into housing 20. The interior cylindrical surface 55 of cylinder 50 defines the compressor cylinder with the portion below the piston head defined by elements 40, 42 and 44 as well as the top 38 of the connecting rod being at normal atmospheric pressure and the portion above the piston head comprising the compression chamber in connection with the valve plate 70 and head 80. Extending around the outer peripheral surface of downwardly depending portion 54 is a compressible spacer 60 which is best seen in FIGS. 2 and 3.

Figure 2:
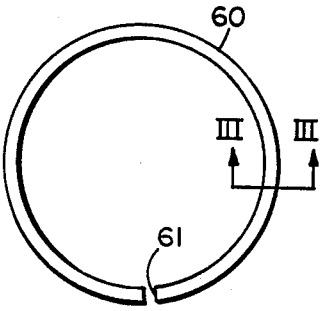
FIG. 2 is a top plan view of the adjustable spacer shown in FIG. 1.
Figure 3:
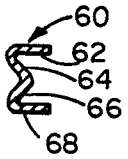
FIG. 3 is an enlarged cross-sectional view of the spacer taken along section lines III—III and FIG. 2.

Spacer 60 is made of 304 stainless steel and is generally ring shaped with a slot 61 formed therein as best seen in FIG. 2. The cross section of the spacer is corrugated as best seen in FIG. 3, thereby defining an integral upper horizontally extending surface 62, a curved inwardly and downwardly depending leg 64, a curved outwardly and downwardly depending leg 66, and terminating in a lower horizontally extending surface 68. The commercially available spacer 60 has an internal diameter of 2.65 inches and an overall uncompressed height of approximately 0.245 to 270 inches and can be compressed to approximately 0.130 inches for providing the adjustable head clearance desired in the compressor of the present invention.

On top of the upper surface of cylinder 50 there is provided a rectangular valve plate 70 which includes a pair of reed valves which operate in a manner similar to that described in detail in U.S. Pat. No. 3,981,631. Basically, the valve plate includes a pair of apertures having overlaying flat, thin stainless steel reeds secured at one end. One of such reeds is mounted to the top of the plate for communicating with the compressor chamber of the head 80 and one on the bottom side communicating with the inlet chamber of head 80 such that as the piston is lowered, the lower reed deflects away allowing air to flow into the compression chamber, and as the piston head moves upwardly, the lower reed closes, sealing off the inlet chamber and the upper reed opens to allow air to exhaust through the head outlet as it is compressed. This operation of the reed valves and in connection with the valve plate is conventional.

The upper reed valve comprising element 72 is shown in FIG. 1 and is attached to valve plate 70 by fastener 74, while the lower reed valve is shown as element 76 in FIG. 1 and is similarly suitably attached to the valve plate. The piston cup retainer plate 44 includes a recess 45 to provide clearance for the fastening means for the lower reed valve 76. It is noted that the piston assembly in FIG. 1 is shown in its uppermost position.

Figure 4:
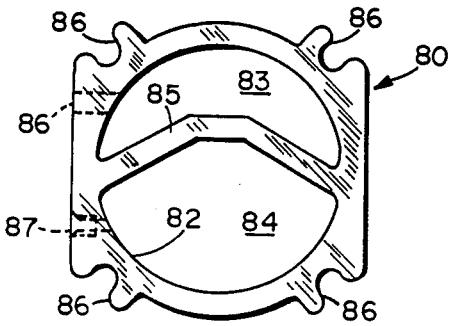
FIG. 4 is a top plan view of the compressor head shown in FIG. 1.
Figure 5:
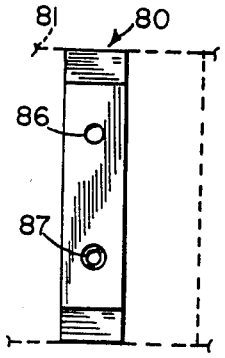
FIG. 5 is a left side elevational view of an extrusion including the structure shown in FIG. 4.

Positioned above the square valve plate 70 is head 80 which is shown in greater detail in FIGS. 4 and 5. Head 80 is also cut from an elongated extrusion 81 (FIG. 5) having a cross-sectional shape shown in FIG. 4. The head is generally rectangular with a circular interior diameter 82 divided into an inlet chamber 83 and an outlet chamber 84 by a partitioning wall 85. An inlet opening 86 is formed through the extrusion to provide an air inlet passageway communicating with inlet chamber 83 while a threaded pressure outlet aperture 87 is formed through the extrusion in communication with outlet chamber 84. The inlet reed valve is positioned on valve plate 70 to be aligned with inlet chamber while the outlet reed valve 72 is aligned with chamber 84 to provide a flow path of compressed air from the top surface of the piston.

The outer diameter of the extrusion defining head 80 includes four (4) ears 86 at the corners thereof which define mounting means which captively hold mounting bolts 100 which extend in the notches defined by the ears 86.

Figure 10:
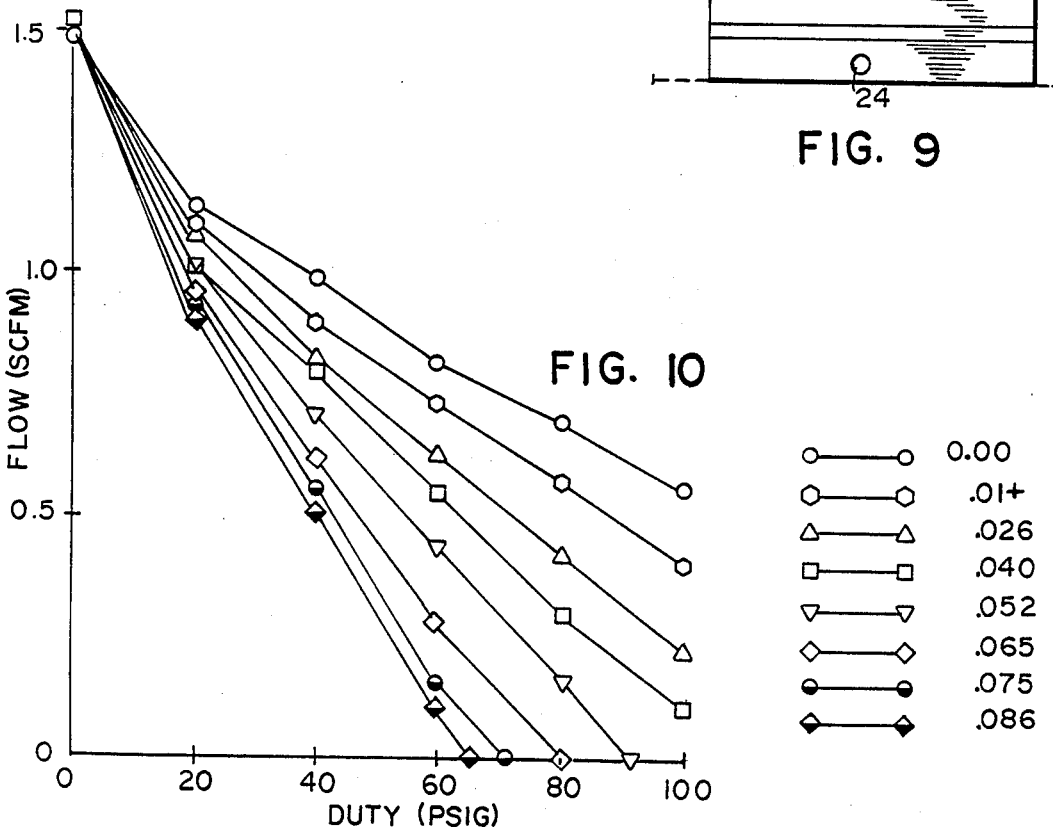
FIG. 10 is a flow versus pressure curve illustrating the performance of the compressor with selected head clearances.

The head assembly is secured to the housing by means of square cover plate 90 which has four (4) apertures 92 aligned with the notches defined by ears 86 for permitting the head bolts 100 to extend therethrough. It is noted that spacer 60 is external to the compression chamber above the upper surface 21 and below the annular cylinder flange 52 and provides no sealing function. The assembly and adjustment of the compressor during assembly to provide the selectable output performance characteristics shown in FIG. 10 is now described. The curves of FIG. 10 are self-explanatory and apply to one model compressor having a 2.5 inch bore with a stroke of 0.325 inches.

During assembly, the motor shaft is inserted through bearing 13. The piston assembly 30 is preassembled with the bearing and counterbalance attached thereto and extended downwardly through opening 22 in the housing. As the motor shaft is extended into the housing, it is also extended through the central opening 11 in the counterbalance 18 and the motor is secured to the housing by two (2) bolts 15. The counterbalance is then secured to the shaft 14 by suitable set screws. The compressible spacer 60 is fitted over the lower end of cylinder 50 and the combination extended over the piston into opening 22 of the housing. Next, the valve plate, head and cover plate are positioned on top of the piston and the bolts 100 loosely threaded into housing 20 to hold the parts in their respective positions.

The compressor is then placed in a press and started with the outlet of the compressor being coupled to a pressure regulator selected for a desired output pressure performance and a flow meter. The press is then actuated to press downwardly on the cover plate while the operator monitors the output flow rate to provide a desired flow rate for the pressure regulated output pressure. Once the desired flow rate is reached, the head bolts 100 are tightened and the compressor assembly is completed. As seen in FIG. 10, by providing a selectable and adjustable top clearance, the operating characteristics of the compressor can be dramatically varied to provide higher or lower flow rates to fit a variety of applications. Also, it is possible to control the flow rate from the compressor and adjust the head to provide a corresponding desired pressure to determine which of the desired operating curves has been reached.

Thus with the compressor of the present invention, the multiple steps of gauging, shimming, testing and reshimming as necessary is avoided, and a relatively fast and accurate assembly method and compressor structure is provided in which a single compressible spacer can be used in place of a variety of different sized shims. This greatly decreases the cost of the compressor, both from a parts standpoint and a labor standpoint, as does the extruded elements which can be cut to provide a plurality of such parts. It will become apparent to those skilled in the art that various modifications to the preferred embodiment as described herein can be made without departing from the spirit or scope thereof as defined in the appended claims.

The embodiments of the invention in which an exclusive property or privilege is claimed are defined as follows:

1. A pneumatic compressor comprising:

a housing for receiving a prime mover, said housing including an opening for receiving a cylinder;

a cylinder extending into said housing for receiving a piston, said cylinder having flange means overlaying the periphery of said opening;

a piston mounted within said cylinder;

deformable spacer means positioned between said flange means and said housing for adjustment during assembly to provide a predetermined output flow rate and pressure characteristic for said compressor;

head means for enclosing said cylinder; and means for securing said head mdans to said housing.

2. A pneumatic compressor comprising:

a housing for receiving a prime mover, said housing including an opening for receiving a cylinder;

a cylinder extending into said housing for receiving a piston, said cylinder having flange means overlaying the periphery of said opening;

a piston mounted within said cylinder;

an adjustable, compressible spacer comprising a corrugated member positioned between said flange means and said housing;

head means for enclosing said cylinder; and means for securing said head means to said housing to compress said adjustable spacer to provide a predetermined head clearance for said piston.

3. The apparatus as defined in claim 2 wherein said flange means defines an annular surface and said corrugated member is ring shaped and substantially surrounds said cylinder and is positioned adjacent said annular surface.

4. The apparatus as defined in claim 3 wherein said corrugated member is made of stainless steel.

5. A compact integrated motor compressor comprising:

a housing for receiving a motor, said housing having an opening for receiving a cylinder;

a motor coupled to said housing and having a rotary output shaft extendiing into said housing;

a cylinder extending into said housing for receiving a piston, said cylinder having an annular flange overlaying the periphery of said opening;

a piston mounted within said cylinder;

an eccentric cam and bearing, coupling said shaft to said piston for reciprocation of said piston in said cylinder;

a compressible spacer positioned between said flange means and said housing;

head means for enclosing said cylinder; and means for securing said head means to said housing to ajust said spacer to provide a predetermined head clearance for said piston such that the flow rate and pressure characteristics of said compressor can be controlled.

6. A compact integrated motor compressor comprising:

a housing for receiving a motor, said housing having an opening for receiving a cylinder;

a motor coupled to said housing and having a rotary output shaft extending into said housing;

a cylinder extending into said housing for receiving a piston, said cylinder having an annular flange overlaying the periphery of said opening;

a piston mounted within said cylinder;

an eccentric cam and bearing, coupling said shaft to said piston for reciprocation of said piston in said cylinder;

an adjustable, compressible spacer positioned between said flange means and said housing wherein said compressible spacer comprises a corrugated member;

head means for enclosing said cylinder; and means for securing said head means to said housing to adjust said spacer to provide a predetermined head clearance for said piston.

7. The apparatus as defined in claim 6 wherein said corrugated member is made of stainless steel.

8. The apparatus as defined in claim 7 wherein said corrugated member is ring shaped.

9. A compressor comprising:

an extruded housing having an integral floor, opposite sidewalls and a top, all extending in longitudinally parallel planes, said top including an opening formed therein for receiving a drive shaft for the compressor;

a cylinder extending into said opening of said housing;

a piston assembly having one end coupled to the drive shaft and the opposite end extending into said cylinder wherein said piston assembly includes a connecting rod which is cut from an elongated extrusion from which a plurality of rods can be obtained;

head means for enclosing an end of said cylinder opposite the drive shaft; and means for coupling said head means to said housing.

10. The apparatus as defined in claim 9 wherein said connecting rod includes a circular end for surrounding said drive shaft and an integral T-shaped opposite end having a flat top surface for securing a piston head thereto.

11. The apparatus as defined in claim 10 wherein said head means comprises an extruded member integrally including channels formed therein for defining in part an inlet chamber and an outlet chamber.

12. The apparatus as defined in claim 11 wherein said extruded member further includes additional channel means for receiving bolt means for securing said head to said housing.

13. The apparatus as defined in claim 12 wherein said housing, connecting rod, and head means are cut from elongated aluminum extrusions.

14. The apparatus as defined in claim 13 wherein said means for coupling said head means to said housing includes a compressible spacer.

15. The apparatus as defined in claim 9 wherein said means for coupling said head means to said housing includes a compressible spacer.

16. A compressor comprising:

a housing including an opening formed therein for receiving a cylinder;

a piston assembly extending into said cylinder;

drive means coupled to said housing and to said piston assembly for reciprocating said piston assembly;

head means for enclosing an end of said cylinder opposite the drive means; and a corrugated, compressible spacer extending between said head means and said housing for adjustably coupling said head means to said housing such that the flow rate and pressure characteristics of said compressor can be selected.

17. The apparatus as defined in claim 16 wherein said piston assembly includes a connecting rod which is cut from an elongated extrusion from which a plurality of rods can be obtained.

18. The apparatus as defined in claim 17 wherein said head means comprises an extruded member integrally including channels formed therein for defining in part an inlet chamber and an air outlet chamber.

* * * * *